United States Patent [19]

Fabricant

[11] 4,081,924

[45] Apr. 4, 1978

[54] YO-YO TOY CARRYING AN ADDITIONAL MEMBER

[76] Inventor: Norman Fabricant, 94-19 64th Rd., Rego Park, N.Y. 11374

[21] Appl. No.: 743,261

[22] Filed: Nov. 19, 1976

[51] Int. Cl.[2] ..... A63H 1/30

[52] U.S. Cl. ..... 46/61

[58] Field of Search ..... 46/51, 61

[56] References Cited

U.S. PATENT DOCUMENTS

| | | | |
|---|---|---|---|
| 1,784,684 | 12/1930 | Bell | 46/61 |
| 1,963,744 | 6/1934 | Houston | 46/61 |
| 2,888,776 | 6/1959 | Sauer | 46/61 |

*Primary Examiner*—Louis G. Mancene
*Assistant Examiner*—Robert F. Cutting
*Attorney, Agent, or Firm*—Alan H. Levine

[57] ABSTRACT

A yo-yo toy including two circular blocks joined by a pin having a string wound around it. An additional member has portions rotatably mounted on the outer faces of the blocks, so that the additional member moves up and down with the blocks as the yo-yo is used, but does not rotate with the blocks. The additional member may be a human or animal figure, or a representation of a real thing, such as an airplane. The pivots joining the additional member to the blocks are on an axis which may be coaxial with the pin axis, or parallel to and spaced from the pin axis. The additional member may remain above the axis of the pin, may depend below the pin axis, or may extend above and below the pin axis when the blocks are suspended from the string. In the first case, the additional member has a hole through which the string extends.

8 Claims, 6 Drawing Figures

YO-YO TOY CARRYING AN ADDITIONAL MEMBER

This invention relates to yo-yos, sometimes called return tops or bandalore tops, and more particularly to a yo-yo toy provided with an additional member which adds to the amusement involved when using the toy.

A yo-yo comprises two circular blocks, usually of wood or plastic, slightly spaced apart and joined at their centers by a pin. A string is wound around the pin in the space between the blocks, one end of the string being secured to the pin. The free end of the string is held by the user and the blocks released. As the blocks fall, they also rotate due to the unwinding of the string. When the string becomes completely unwound, the continued rotation of the blocks causes the string to be rewound on the pin and hence the blocks rise and return to the hand of the user.

Yo-yos have in the past been embellished, such as by surface decoration and by means for illuminating the blocks as they rotate, as a way of increasing the enjoyment of using the yo-yos.

It is an object of the present invention to embellish a yo-yo in a new and different way so as to add greatly to the amusement of the user of the yo-yo and those watching the user.

It is another object of the invention to provide a yo-yo with an additional member which moves up and down with the blocks but does not rotate with them. The additional member may be a replica of a human or animal figure, a cartoon character, or a thing.

It is a further object of the invention to provide such a yo-yo toy wherein the additional member is pivoted to the blocks on a pivot axis coaxial with the axis of the pin joining the blocks. Alternatively, the pivot axis may be eccentric with respect to the pin axis, in which case the additional member will experience a compound movement involving a reciprocation superimposed on its up and down movement with the blocks.

It is an additional object to provide such a yo-yo toy wherein the additional member remains above the pin axis when the blocks are suspended from the string. In alternative embodiments, the additional member may hang below the pin axis, or may extend above and below the pin axis.

Additional objects and features of the invention will be apparent from the following descritpion in which reference is made to the accompanying drawings.

Figure 1:
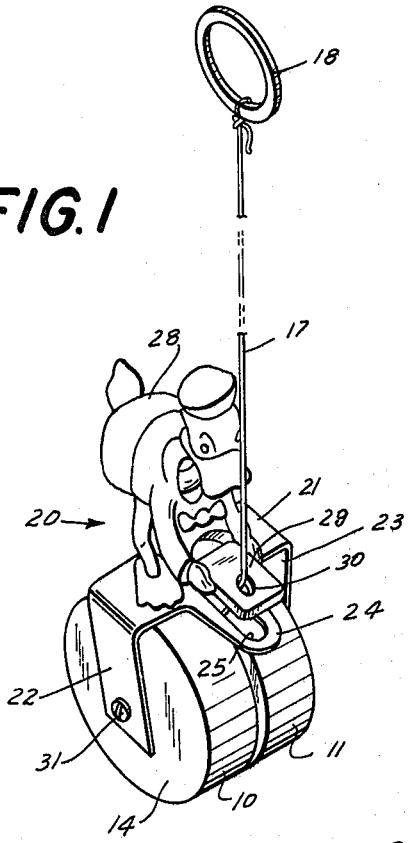
FIG. 1 is a perspective view of a yo-yo toy according to the present invention in which the additional member is maintained above the pin axis during use.
Figure 2:
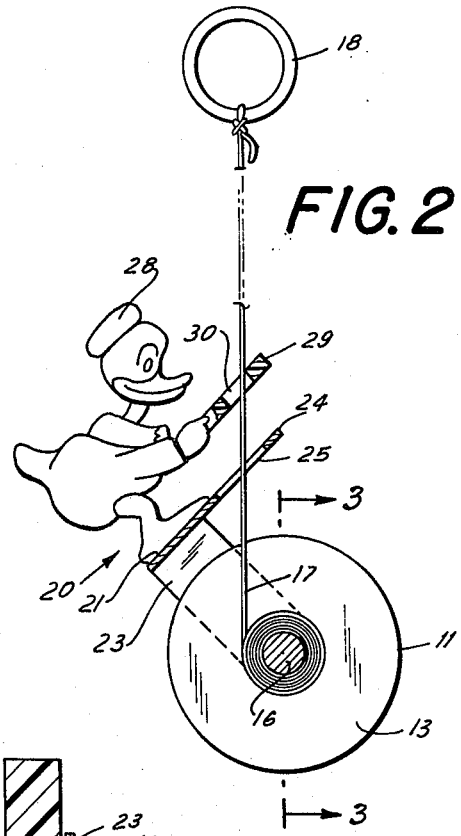
FIG. 2 is a vertical cross-sectional view through the yo-yo toy of FIG. 1.
Figure 3:
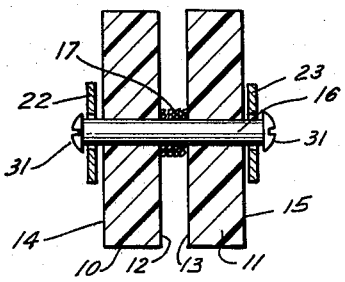
FIG. 3 is a vertical cross-sectional view taken along line 3—3 of FIG. 2.

A yo-yo toy chosen to illustrate the present invention, and shown in FIGS. 1–3, comprises a pair of circular, disk-like, blocks 10 and 11, arranged coaxially in parallel planes. The blocks have inner faces 12 and 13 facing each other, and outer faces 14 and 15 facing in opposite directions. The inner faces 12 and 13 of the blocks 10 and 11 are spaced apart, as shown most clearly in FIGS. 1 and 3, and the blocks are joined at their centers by a pin 16. A string 17 extends into the space between the block faces 12 and 13, and is wound around the portion of pin 16 exposed within the space between blocks. The inner end of the string is secured to pin 16. This securement may be such that the inner end of the string is fixed with respect to the pin, or alternatively the inner end of the string may be formed with a small loop which fits around pin 16 so that the pin can rotate with respect to the loop. The free end of string 17 is furnished with a ring 18 through which a finger of the user of the toy may be inserted.

As thus far described, the yo-yo toy is completely conventional. However, according to the present invention, an additional means 20 is carried by the blocks 10 and 11. The additional means comprises a U-shaped bracket including a central platform portion 21 and two arms 22 and 23 depending from the ends of portion 21. Platform 21 is extended at the mid portion of one of its lateral edges to define a guide 24 having an opening 25.

Mounted on platform 21 is an embellishment, in this example a figure of a duck 28. The duck holds a small plate 29 between its hands, the plate having a hole 30. String 17 extends through opening 25 in guide 24 and through hole 30 in plate 29.

Pin 16 extends completely through blocks 10 and 11, and the ends of pin 16 extend beyond the outer faces 14 and 15 of the blocks. A hole is formed near the free end of each arm 22 and 23 of the U-shaped bracket, and the ends of pin 16 fit loosely through the holes in the bracket arms. In this way, the ends of pin 16 serve as pivot means for rotatably securing the U-shaped bracket to the outer faces of blocks 10 and 11. The ends of pin 16 are formed with enlargements 31, such as screw heads, to prevent arms 22 and 23 from slipping outwardly off the ends of the pin.

It will be seen, therefore, that the additional means, or embellishment, 20 is rotatably mounted on the blocks 10 and 11 of the yo-yo. Hence, the additional means can move up and down with blocks 10 and 11, but without rotating. As may be seen most clearly in FIG. 2, string 17 passing through hole 30 maintains the additional means 20 above the axis of pin 16 when the toy is suspended from the string. If string 17 did not pass through hole 30, the additional means 20 would swing downwardly and hang beneath the axis of pin 16. Guide 24 is not essential, but has been found useful for preventing the portion of string 17 between plate 29 and the blocks from looping around the arms 22 and 23 and hence preventing operation of the toy.

Figure 4:
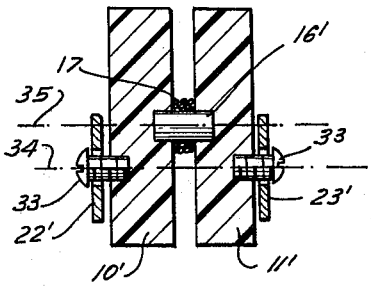
FIG. 4 is a view similar to FIG. 3 showing an alternative embodiment of the yo-yo toy.

In the embodiment just described, the axis of the pivot connections between the ends of bracket arms 22 and 23 and the outer faces of blocks 10 and 11 is coaxial with pin 16. However, as illustrated in FIG. 4, the axis of the pivot connections could be spaced from the axis of the pin. In the arrangement of FIG. 4, blocks 10' and 11' are interconnected by a much shorter pin 16', which fits into bores in the inner faces of the blocks, but does not extend through the blocks. The pivot connections between arms 22' and 23' and blocks 10' and 11', respectively, are formed by screws 33 which fit loosely through the holes in bracket arms 22' and 23' and are fixed in blocks 10' and 11'. Screws 33 are arranged on an axis 34 parallel to and spaced from the axis 35 of pin 16'.

As a result of the arrangement shown in FIG. 4, when the blocks 10' and 11' are rotating, either upwardly or downwardly along string 17, the eccentric arrangement of pivots 33 with respect to axis 35 will cause the additional means 20 to experience a compound movement comprising a reciprocating movement superimposed upon the up and down movement of blocks 10' and 11'.

It may be mentioned that although in FIGS. 1–3, the ends of pin 16 form the pivot connections between arms 22 and 23 and blocks 10 and 11, this need not necessarily be the case. Even in the FIGS. 1–3 embodiment, a short pin 16, similar to pin 16' of FIG. 4 could be used, and separate screws, or other fasteners, similar to screws 33 could be employed arranged coaxially with the shorter pin 16'.

Figure 5:
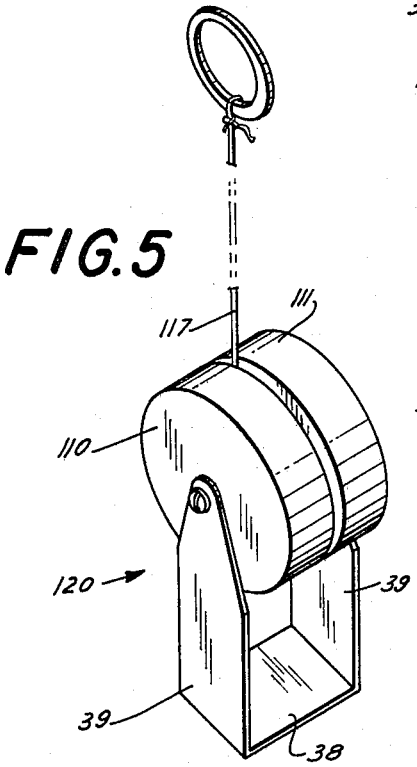
FIG. 5 is a perspective view of another alternative embodiment of the invention wherein the additional member is suspended below the pin axis.

In the embodiment of FIGS. 1–3, the additional means 20 is, as pointed out above, maintained above the axis of pin 16. In some cases, it may be desirable to permit the additional means to hang below the axis of pin 16. Such an arrangement is illustrated in FIG. 5. In this arrangement, the embellishment is represented by a U-shaped bracket 120 rotatably secured to the outer faces of blocks 110 and 111, the blocks being joined by a pin (not shown) around which a string 117 is wound. A figure of some type could be seated on the central platform portion 38 of bracket 120.

It should be made clear that the U-shaped brackets of FIGS. 1 and 5 are shown only by way of illustration. Many other arrangements are possible. For example, the arms 22 and 23 of the bracket could be thought of as representing the legs of a figure which would then appear to straddle the blocks 10 and 11. Similarly, the arms 39 of bracket 120 could be thought of as the arms of the figure which would then appear to be hanging by its arms from the blocks 110 and 111.

Figure 6:
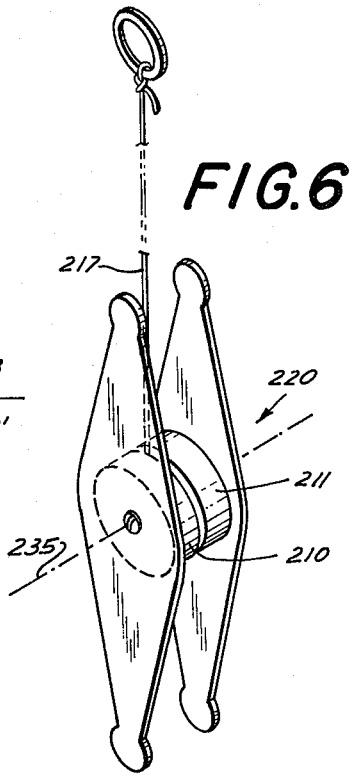
FIG. 6 is a perspective view of a further alternative embodiment of the invention wherein the additional member extends above and below the pin axis.

The arrangement of FIG. 6 differs from the embodiments described above in that the additional means 220 extends both above and below the axis 235 of the pin joining the blocks 210 and 211. The additional means is shown as two generally diamond shaped plates rotatably secured to the outer faces of the blocks. These plates are illustrative, and could represent, for example, an airplane model having the blocks 210 and 211 within it. Thus, as the toy is used, the airplane would move up and down on string 217, but would not rotate with blocks 210 and 211.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A yo-yo toy comprising:

a. two circular blocks arranged in parallel planes, said blocks being spaced apart and having inner faces facing each other and outer faces facing in opposite directions, b. a pin joining the inner faces of said blocks at their centers, c. a string extending into the space between said blocks and having one end secured to said pin, d. additional means carried by said blocks, said additional means having a portion rotatably mounted on the outer face of each of said blocks, e. a hole in a portion of said additional means which is spaced from said blocks, said string extending through said hole, so that when said blocks are suspended from said string said additional means is maintained above the level of the axis of said pin, and f. a guide forming part of said additional means, said guide having an opening through which said string extends, and said guide being between said portion having said hole and said blocks and being spaced from both said portion and said blocks.

2. A yo-yo toy as defined in claim 1 including pivot means rotatably joining each of said additional means portions to the outer face of its respective block, both of said pivot means being on a single axis parallel to the axis of said pin.

3. A yo-yo toy as defined in claim 2 wherein the axis of said pivot means is spaced from the axis of said pin.

4. A yo-yo toy as defined in claim 1 including pivot means rotatably joining each of said additional means portions to the outer face of its respective block, said pivot means being coaxial with said pin.

5. A yo-yo toy as defined in claim 4 wherein said pin extends through both of said blocks and the ends of said pin extend beyond the outer faces of said blocks, said pin ends comprising said pivot means.

6. A yo-yo toy as defined in claim 1 wherein said additional means depends from said blocks when the latter are suspended from said string.

7. A yo-yo toy as defined in claim 1 wherein said additional means extends above and below the axis of said pin when said blocks are suspended from said string.

8. A yo-yo toy as defined in claim 1 wherein said additional means includes a U-shaped bracket straddling said blocks, one area of said bracket being rotatably secured to the outer face of each block.

* * * * *